US007744024B2

(12) United States Patent
Abramson et al.

(10) Patent No.: US 7,744,024 B2
(45) Date of Patent: Jun. 29, 2010

(54) COMBINATION SHREDDER HEAD AND BASKET AND METHOD OF MANUFACTURING SAME

(76) Inventors: Aron Abramson, 2025 E. 9 St., Brooklyn, NY (US) 11223; Charles Sued, 3360 Bedford Ave., Brooklyn, NY (US) 11210

( * ) Notice: Subject to any disclaimer, the term of this patent is extended or adjusted under 35 U.S.C. 154(b) by 940 days.

(21) Appl. No.: 11/222,658

(22) Filed: Sep. 10, 2005

(65) Prior Publication Data

US 2007/0057098 A1 Mar. 15, 2007

(51) Int. Cl.
*B02C 17/16* (2006.01)

(52) U.S. Cl. ..... 241/27; 241/30

(58) Field of Classification Search ..... 241/100, 241/236, 27, 30

See application file for complete search history.

(56) References Cited

U.S. PATENT DOCUMENTS

| | | | | |
|---|---|---|---|---|
| 1,368,774 | A * | 2/1921 | Votruba | 220/9.1 |
| 2,308,578 | A | 1/1943 | White et al. | |
| 3,052,581 | A * | 9/1962 | Gutknecht | 216/54 |
| 3,682,402 | A * | 8/1972 | Goldhammer | 241/100 |
| 4,650,128 | A | 3/1987 | Goldhammer | |
| 5,054,695 | A | 10/1991 | Koornhof | |
| 5,318,821 | A * | 6/1994 | Bradley, Jr. | 428/100 |
| 5,474,241 | A | 12/1995 | Kennedy | |
| 5,553,733 | A * | 9/1996 | Rosenthal | 428/35.2 |
| 5,562,229 | A * | 10/1996 | Callahan | 220/694 |
| 5,839,675 | A | 11/1998 | Henreckson et al. | |
| 5,934,584 | A | 8/1999 | Schwelling | |
| 5,988,542 | A * | 11/1999 | Henreckson et al. | 241/100 |
| 6,079,645 | A | 6/2000 | Henreckson et al. | |
| D437,343 | S | 2/2001 | Ho | |
| D446,543 | S | 8/2001 | Ho | |
| D449,850 | S | 10/2001 | Ho | |
| D454,907 | S | 3/2002 | Ho | |
| D455,170 | S | 4/2002 | Ho | |
| D455,171 | S | 4/2002 | Ho | |
| 6,390,397 | B1 | 5/2002 | Ko | |
| 6,513,740 | B2 | 2/2003 | Ho | |
| 6,588,616 | B1 | 7/2003 | Ho | |
| D498,252 | S | 11/2004 | Lo | |
| D498,253 | S | 11/2004 | Lo | |
| D502,729 | S | 3/2005 | Lo | |
| D502,960 | S | 3/2005 | Lo | |
| D502,961 | S | 3/2005 | Lo | |
| 2004/0074907 | A1 * | 4/2004 | Gardner | 220/495.11 |

* cited by examiner

*Primary Examiner*—Bena Miller
(74) *Attorney, Agent, or Firm*—Garcia-Zamor IP Law; Ruy M. Garcia-Zamor

(57) ABSTRACT

A combination shredder head and shredder basket with improved tactile property.

18 Claims, 3 Drawing Sheets

COMBINATION SHREDDER HEAD AND BASKET AND METHOD OF MANUFACTURING SAME

BACKGROUND

The present invention is generally directed to shredders and, more specifically, to a combination shredder head and shredder basket and a method of manufacturing same.

Conventional shredders have baskets formed entirely of steel or polymer. This results in shredders that are rigid to the touch which creates an unpleasant tactile experience for a user. Additionally, current shredder baskets are aesthetically less pleasing as the polymer or steel shredder baskets stand out in a well furnished office and can create a sterile feeling atmosphere.

It would be advantageous to provide a combination shredder head and shredder basket that has a shredder basket with improved tactile properties; that is aesthetically pleasing; that is preferably formed of leather; and that may use leather and/or other material as part of a two layer or three layer construction.

SUMMARY

Briefly speaking, one preferred embodiment of the present invention is directed to a method of manufacturing a combination shredder head and shredder basket with improved tactile property. The method includes: providing a basket frame having an exterior surface and an upper end defining an opening, wherein the basket frame provides strength and rigidity to the shredder basket; placing material having the appearance of leather over the exterior of the basket frame to form a shredder basket having the appearance of being formed of leather, wherein the material provides a more comfortable tactile surface for a user; and positioning the shredder head at least partially inside the opening.

In a separate aspect, the present invention is directed to a combination shredder head and shredder basket. The combination includes a shredder head. A shredder basket has a base and an upper end. The shredder basket is substantially leather and defines an opening configured to receive the shredder head therein. Wherein when the shredder head is engaged with the shredder basket, the shredder head occupies substantially all of the opening along the upper end of the shredder basket.

In a separate aspect, the present invention is directed to a combination shredder head and shredder basket. The combination including a shredder head. The shredder basket has a base and upper end. The shredder basket is substantially leather and defines an opening configured to receive the shredder head therein. The shredder basket includes a frame having exterior and interior surfaces. An outer material is disposed on the exterior surface of the frame. A liner is disposed on the interior surface of the frame. Wherein the outer material has a texture representing leather.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
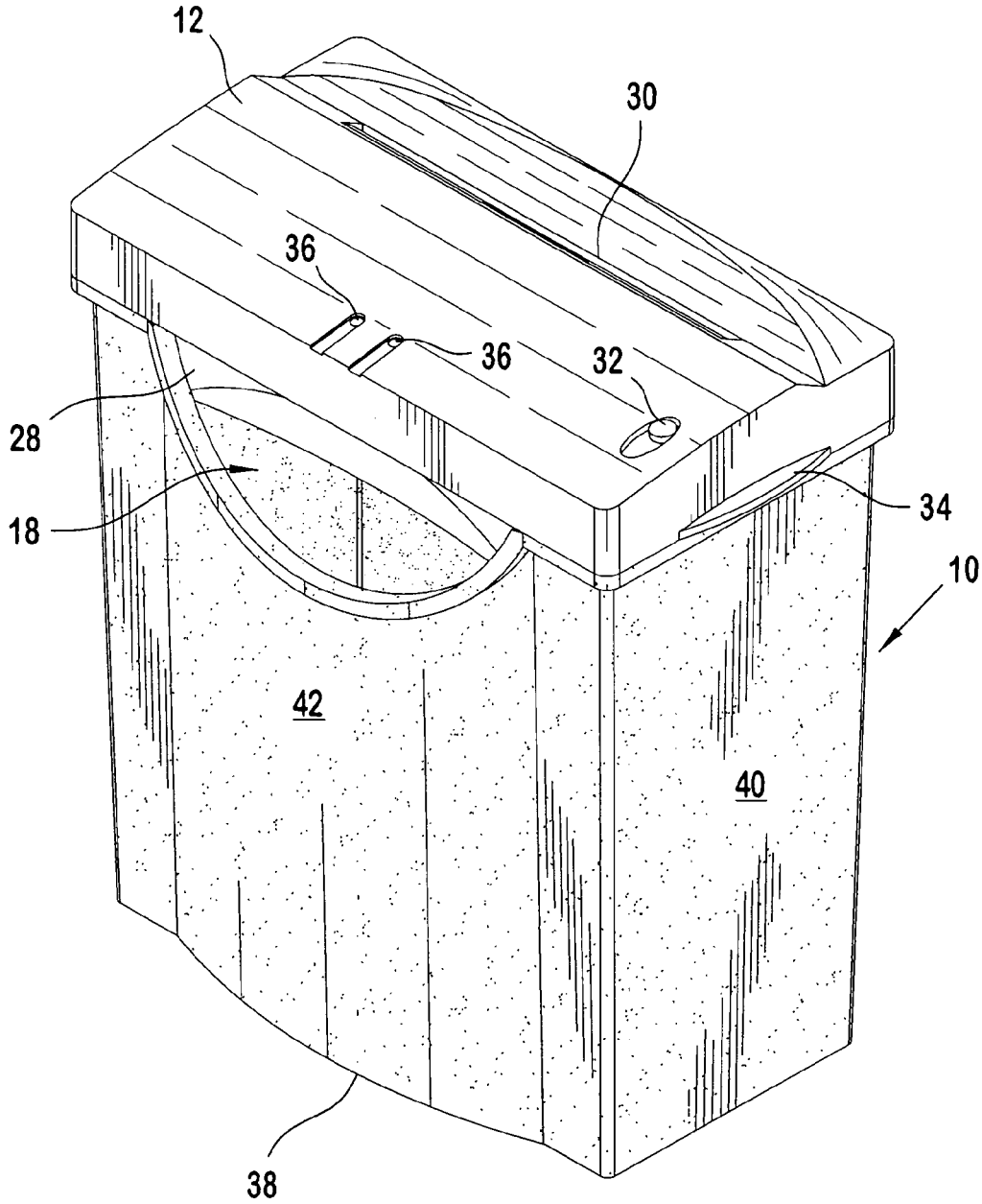
FIG. 1 is a perspective view of a combination shredder head and shredder basket according to a preferred embodiment of the present invention.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-4, wherein like numerals indicate like elements throughout, there is shown a preferred embodiment of a combination shredder basket and shredder head, generally designated 10 and 12, respectively. Briefly stated, the shredder basket 10 of the present invention may be formed substantially of leather or another exterior material and may be formed by multiple layers.

Referring to FIG. 1, one embodiment of the present invention includes a shredder head 12. The shredder head 12 has a slot 30 for inserting material to shred. The slot 30 guides material to be shredded to cutting blades that are driven by a motor located in the shredder head 12. The shredder head 12 preferably receives power from an outlet via an electrical cord. However, the shredder head 12 can be powered by batteries or any other suitable power source. The shredder head 12 preferably includes a power switch 32 and operating indicators 36.

Shredder head handles 34 are preferably configured to allow easy lifting of the shredder head 12 from the shredder basket 10. While the preferred shredder head 12 has a generally rectilinear shape, those of ordinary skill in the art will appreciate from this disclosure that the shredder head 12 can have any shape without departing from the scope of the present invention. The shredder head 12 may also include a bin full indicator.

Figure 2:
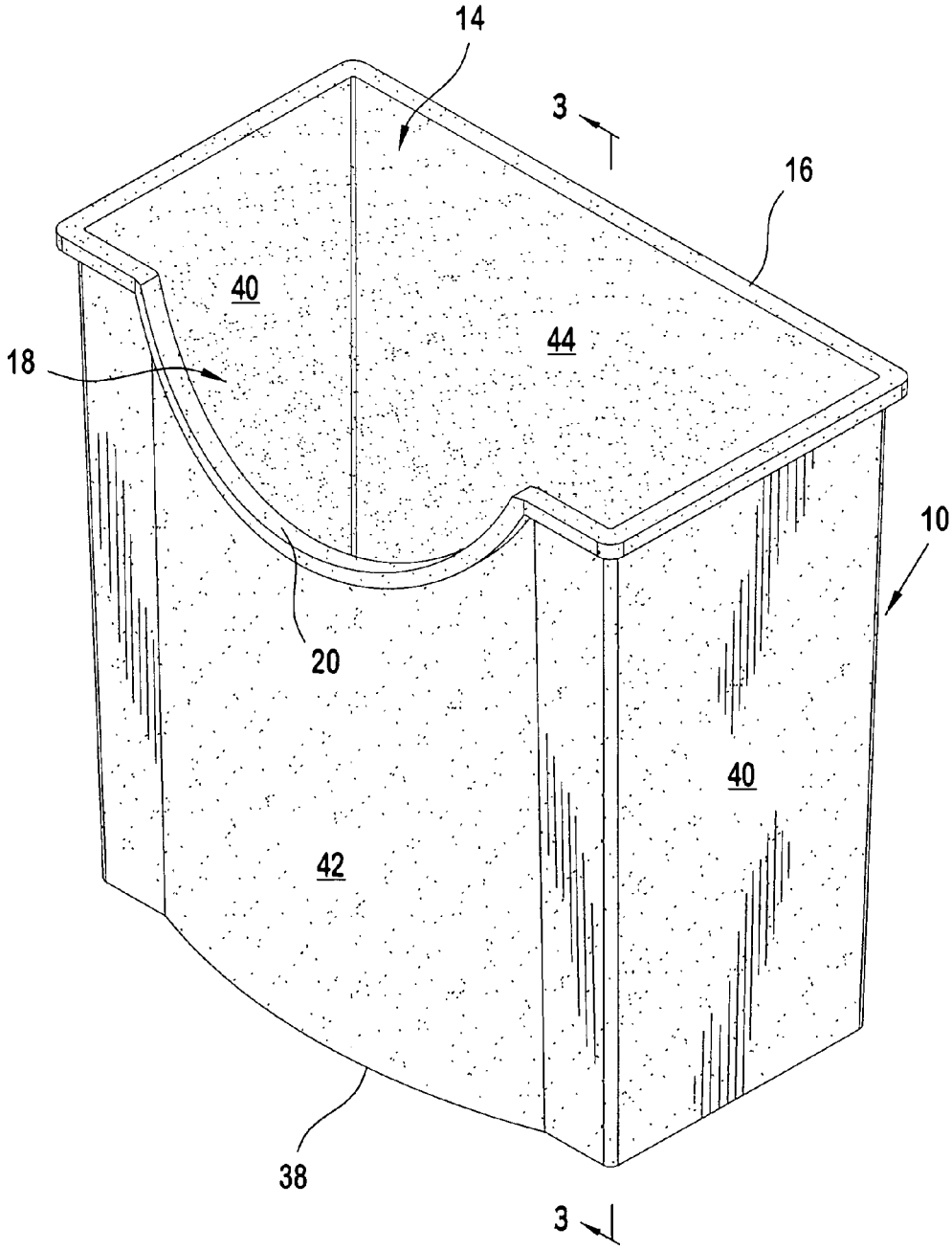
FIG. 2 is a perspective view of the shredder basket of FIG. 1.

As best shown in FIG. 2, the shredder basket 10 of the present invention has a base 38, front side 42, rear side 44, and lateral sides 40. The shredder basket 10 has an upper end defining an opening 14 configured to receive the shredder head 12 therein. It is preferred that when the shredder head 12 is engaged with the shredder basket 10, that the shredder head 12 occupies substantially all of the opening 14 along the upper end of the shredder basket 10. Those of ordinary skill in the art will appreciate from this disclosure that, depending on design, a portion of the opening 14 on the upper end of the shredder basket 10 may not be covered by the shredder head 12. Less than total coverage of the opening 14 by shredder head 12 will not prevent the shredder head 12 from substantially covering the opening 14.

Referring to FIGS. 1 and 2, one embodiment of the shredder basket 10 preferably includes a front side 42 that is curvilinear about an axis generally perpendicular to the base 38 to form a generally convex section. The front side 42 preferably also includes a passage 18 therethrough that has an arcuate shape and is located adjacent to the opening 14. The upper lip 16, 20 can extend around the perimeter of the opening 14 and passage 18. The passage 18 can be sized sufficiently to allow a user to see the contents in the shredder basket 10 without removing the shredder head 12 and/or to determine whether the shredder basket 10 is close to full. While a preferred shredder basket 10 shape is shown in FIGS. 1 and 2, those of ordinary skill in the art will appreciate from this disclosure that the shredder basket 10 can have any suitable shape or configuration without departing from the scope of the present invention.

Figure 3:
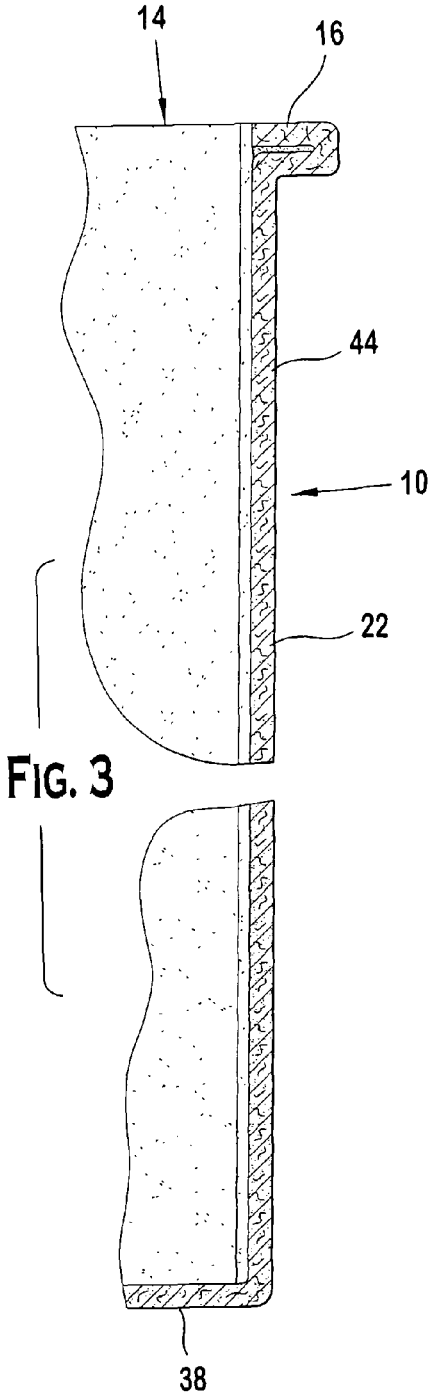
FIG. 3 is a partial cross-sectional view of the shredder basket of FIG. 2 as taken along the line 3-3 of FIG. 2 and illustrates a preferred construction of the shredder basket.

As best shown in FIG. 3, one preferred embodiment of the shredder basket 10 is formed substantially by a layer 22 of leather or a leather like material. However, those of ordinary skill in the art will appreciate from this disclosure that the layer 22 may be formed of other materials, such as padded fabric, elastomer or the like, without departing from the scope of the present invention. When the shredder basket 10 is formed substantially of leather 22, it is preferred that the shredder basket 10 include an upper lip 16 formed by a portion of the leather 22 folded over onto itself to form a layer including at least two layers of leather 22. Adhesive can be used between the leather layers without departing from the scope of the present invention.

Figure 4:
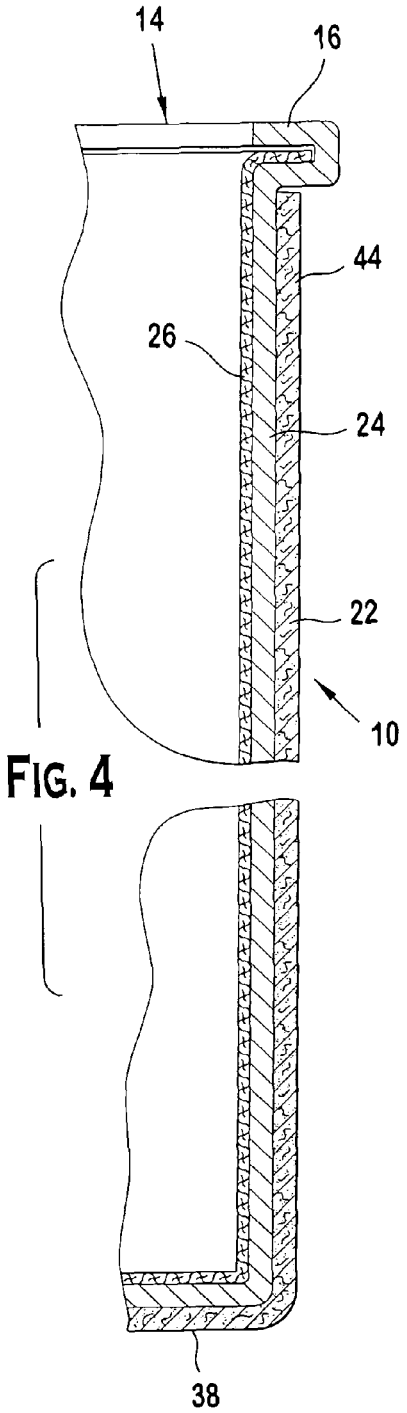
FIG. 4 is a partial cross-sectional view similar to FIG. 3 illustrating another preferred construction of the shredder basket of the present invention.

Referring to FIG. 4, a preferred embodiment of the shredder basket 10 can be formed by two or more layers of material. The shredder basket 10 may include a basket frame 24. The basket frame 24 can be formed by at least one of a metal, a steel, an alloy, a wood, a wood composite, a polymer, laminated fabric, molded paper and/or the like. Many materials that are not suited for use with a shredder head 12, such as wood and molded paper, can be used when combined with an outer material 22 and/or a liner 26.

The basket frame 24 may not extend along the entire area of the shredder basket 10 to reduce weight. As such, the basket frame 24 can have a picket fence, Swiss cheese, skeletal, or outer perimeter design without departing from the scope of the present invention. To compensate for less than total area coverage by the basket frame 24, the material 22 covering the exterior of the basket frame 24 and/or a liner 26 covering the interior of the basket frame 24 are preferably positioned to provide a generally continuous and solid surface for the shredder basket (as shown in FIGS. 1 and 2). Those of ordinary skill in the art will appreciate from this disclosure that the liner 26 can be formed of any suitable material without departing from the scope of the present invention.

Referring to FIGS. 1 and 4, one method of the present invention is as follows. A combination shredder head 12 and shredder basket 10 with improved tactile property is manufactured by providing a basket frame 24. The basket frame 24 has an exterior surface and an upper end defining an opening 14. The basket frame 24 can provide strength and rigidity to the shredder basket 24.

Material 22 having the appearance of leather is preferably placed over the exterior of the basket frame 24 to form a shredder basket 10 having the appearance of being formed of leather. The material 22 preferably provides a more comfortable tactile surface for a user. The material 22 preferably results in the outer surface of the shredder basket 10 having a reduced hardness when pressed radially inwardly. Additionally, the material 22 can provide an improve gripping surface that has a higher coefficient of friction with human hands than that of convention shredder baskets. It is preferred that the placing of material 22 over the basket frame 24 softens the exterior of the shredder basket 10 to allow the use of rougher material to form the basket frame 24 or to further improve the tactile properties of the shredder basket. As mentioned above, the material 22 can be any one or combination of suitable materials, such as padded fabric, elastomer or the like, without departing from the scope of the present invention.

The method may include positioning adhesive between the basket frame 24 and the material 22. Optionally, a liner 26 may be placed along an interior surface of the basket frame 24.

In general the use of leather on the outer surface of the shredder basket 10 or to substantially form the leather basket, provides a more aesthetically pleasing shredder basket 10. The leather increases the smoothness of the shredder basket 10 corners and reduces the chance of injury due to scratching or collision of the shredder basket 10 with people or other furniture. Additionally, the material 22 of the shredder basket 10 provides a softer surface that is more pleasant to lift for emptying, which for larger shredders dramatically increase comfort. The use of leather and other exterior materials 22 allows an increased variety of textures and colors to be used with the shredder basket 10.

It is recognized by those skilled in the art that changes may be made to the above described methods and/or shredder baskets 10 without departing from the broad inventive concept thereof. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A method of manufacturing a combination shredder head and shredder basket with improved tactile property, comprising:

providing a basket frame formed substantially of molded paper having an exterior surface and an upper end defining an opening, wherein the basket frame provides strength and rigidity to the shredder basket;

placing material having the appearance of leather over the exterior of the basket frame to form a shredder basket having the appearance of being formed of leather, wherein the material provides a more comfortable tactile surface for a user, the shredder basket having an upper lip and a side defining a passage proximate the upper lip;

positioning adhesive between the basket frame and the material; and positioning the shredder head at least partially inside the opening so that the shredder head covers the upper end of the shredder basket and engages the perimeter of the opening except for the passage, wherein the passage is adapted to allow a person to see inside the shredder basket without removing the shredder head to determine the amount of material in the shredder basket.

2. The method of claim 1, wherein the step of placing the material results in the outer surface of the shredder basket having a reduced hardness.

3. The method of claim 2, wherein the step of placing the material further comprises the material being formed substantially of leather.

4. The method of claim 2, wherein the step of placing the material further comprises the material being formed substantially of elastomer.

5. The method of claim 1, further comprising placing a liner along the interior of the basket frame.

6. The method of claim 5, wherein the step of providing the basket frame further comprises the basket frame not extending along the entire area of the shredder basket to reduce weight, the material covering the exterior of the shredder basket and the liner covering the interior of the shredder basket to provide a generally continuous and solid surface for the shredder basket.

7. The method of claim 1, wherein the step of providing the shredder basket further comprises providing the shredder basket with the passage through the front side sufficient to see whether the shredder basket is close to full.

8. The method of claim 7, wherein the step of placing material further comprises the outer material being leather.

9. The method of claim 8, wherein the step of placing material over the shredder basket softens the exterior of the shredder basket to allow the use of rougher material to form the basket frame.

10. A method of manufacturing a combination shredder head and shredder basket with improved tactile property, comprising:

providing a basket frame having an exterior surface and an upper end defining an opening, wherein the basket frame provides strength and rigidity to the shredder basket, the basket frame not extending along the entire area of the shredder basket to reduce weight;

placing material having the appearance of leather over the exterior of the basket frame to form a shredder basket having the appearance of being formed of leather, wherein the material provides a more comfortable tactile surface for a user, the material covering the exterior of the shredder basket to provide a generally continuous and solid surface for the shredder basket, the shredder basket having a an upper end, an upper lip and a side defining a passage proximate the upper lip; and positioning adhesive between the basket frame and the material positioning the shredder head at least partially inside the opening so that the shredder head covers the upper end of the shredder basket and engages the perimeter of the opening except for the passage, wherein the passage is adapted to allow a person to see inside the shredder basket without removing the shredder head to determine the amount of material in the shredder basket.

11. A method of manufacturing a combination shredder head and shredder basket with improved tactile property, comprising:

providing a basket frame substantially formed of molded paper having an exterior surface and an upper end defining an opening, wherein the basket frame provides strength and rigidity to the shredder basket;

placing material having the appearance of leather over the exterior of the basket frame to form a shredder basket having the appearance of being formed of leather, wherein the material provides a more comfortable tactile surface for a user, the material covering the exterior of the shredder basket to provide a generally continuous and solid surface for the shredder basket, the upper end of the shredder basket defining an upper lip and a side of the shredder basket defining a perimeter extending around the opening;

positioning adhesive between the basket frame and the material;

providing a shredder head that is configured to specifically engage the shredder basket along the material; and positioning the shredder head at least partially inside the opening so that the shredder head is configured to contact the basket along the entire perimeter, wherein the shredder head engages the material along the perimeter of the shredder basket.

12. The method of claim 11, wherein the step of positioning the shredder head includes the shredder head being flush with the lateral sides of the upper lip.

13. The method of claim 11, wherein the step of placing the material further comprises the material being formed substantially of leather.

14. The method of claim 11, wherein the step of placing the material further comprises the material being formed substantially of elastomer.

15. The method of claim 11, further comprising positioning adhesive between the basket frame and the material.

16. The method of claim 15, further comprising placing a liner along the interior of the basket frame.

17. The method of claim 16, wherein the step of providing the basket frame further comprises the basket frame not extending along the entire area of the shredder basket to reduce weight, the material covering the exterior of the shredder basket and the liner covering the interior of the shredder basket to provide a generally continuous and solid surface for the shredder basket.

18. The method of claim 17, wherein the step of placing material over the shredder basket softens the exterior of the shredder basket to allow the use of rougher material to form the basket frame.

* * * * *